United States Patent [19]

Ericsson et al.

[11] Patent Number: 4,669,377

[45] Date of Patent: Jun. 2, 1987

[54] STENCIL FRAME FEEDING AND DISCHARGING ARRANGEMENT

[75] Inventors: Sylve J. D. Ericsson; Nils A. E. Lindström, both of Tumba, Sweden

[73] Assignee: Svecia Silkscreen Maskiner AB, Norsborg, Sweden

[21] Appl. No.: 729,991

[22] Filed: May 3, 1985

[30] Foreign Application Priority Data

May 8, 1984 [SE] Sweden ..... 8402460

[51] Int. Cl.[4] ..... B41F 15/08; B41F 15/34

[52] U.S. Cl. ..... 101/114; 101/126

[58] Field of Search ..... 101/115, 121, 123, 126, 101/124, 128, 48, 51, 114

[56] References Cited

U.S. PATENT DOCUMENTS

| | | | |
|---|---|---|---|
| 1,916,985 | 7/1933 | Ogsbury et al. | 101/48 X |
| 2,061,679 | 11/1936 | Simonton | 101/123 |
| 2,206,176 | 7/1940 | Foard | 101/126 |
| 2,528,435 | 10/1950 | Isett | 101/48 X |
| 2,610,577 | 9/1952 | Heintges | 101/115 |
| 2,710,577 | 6/1955 | Prett | 101/126 X |
| 3,411,440 | 11/1968 | Johnston et al. | 101/123 |
| 3,793,950 | 2/1974 | Kaneko et al. | 101/142 |
| 3,838,639 | 10/1974 | Harwell, Jr. et al. | 101/123 |
| 4,195,567 | 4/1980 | Mitter | 101/126 X |

FOREIGN PATENT DOCUMENTS

| | | | |
|---|---|---|---|
| 870517 | 3/1942 | France | 101/115 |
| 8202816-8 | 5/1982 | Sweden . | |
| 2034638 | 6/1980 | United Kingdom | 101/115 |
| 0765022 | 9/1980 | U.S.S.R. | 101/115 |

*Primary Examiner*—Charles A. Pearson

*Attorney, Agent, or Firm*—Burns, Doane, Swecker & Mathis

[57] ABSTRACT

An arrangement for feeding a stencil frame having a stencil mounted therein to a silk screen printing machine and/or for discharging a stencil frame therefrom, in which the silk screen printing machine is provided with means for receiving a stencil frame and means for holding the stencil frame firmly in the printing machine. One or more stencil frame magazines are arranged between the printing machine a transfer and arrangement for feeding a stencil frame to the magazine and/or receiving a stencil frame therefrom.

Each magazine is allocated horizontal planes for each of which there is provided means adapted to feed a stencil frame to the printing machine and/or adapted to remove a stencil frame from the printing machine.

10 Claims, 4 Drawing Figures

STENCIL FRAME FEEDING AND DISCHARGING ARRANGEMENT

FIELD OF THE INVENTION

The present invention relates to an arrangement for feeding a stencil frame with a stencil mounted thereon to a silk screen printing machine and/or for discharging such a stenil frame therefrom.

The arrangement according to the invention has a particular value when used in conjunction with a silk screen printing machine provided with means for receiving a stencil frame and with which means are provided to firmly hold the stencil frame in the silk screen printing machine, and preferably also means capable of registering the stencil frame in the machine.

BACKGROUND OF THE INVENTION

In Swedish Patent Application No. 8202816-8 there is described an arrangement for holding and/or registering a stencil frame in a silk screen printing machine which comprises, inter alia, a printing platen and a squeegee arrangement and/or ink re-filling means located above the platen. Arranged between the printing platen and the squeegee arrangement for co-operation with the stencil frame are one or more members which are constructed to permit the stencil frame to be displaced or otherwise moved to an adjusted position in the silk screen printing machine, and vice versa, and in which printing machine registering means are provided for orienting the stencil frame in a registered position and holding the frame firmly in position.

This known arrangement includes means by which the frame can be moved manually in a direction at right angles to the transport direction of the material, via guide means positioned transversely to the machine.

Thus, the arrangement includes a manually manouverable arrangement which delivers a stencil frame to the silk screen printing machine and/or receives a stencil frame therefrom.

It is known from U.S. Pat. No. 2,206,176 to provide a magazine in which a plurality of stencil frames with stencils mounted thereto are stored, each of the stencils having a different pattern to the other, and wherein it is possible to move a stencil frame manually from the magazine to the printing platen of the silk screen printing machine.

SUMMARY OF THE INVENTION

TECHNICAL PROBLEM

A primary technical problem in this particular art is one of creating conditions and constructing simple means which enable a stencil frame with stencil attached and placed in a silk screen printing machine to be changed with ease for another stencil frame with stencil mounted thereon.

A further qualified technical problem is one of creating means whereby a stencil frame having a stencil mounted thereon and positioned in a silk screen printing machine can be automatically replaced in a simple manner with another stencil frame having a stencil mounted thereon.

It is a known fact in the art that the work entailed in exchanging one stencil frame for another is both heavy and troublesome and also highly time consuming, and hence a further qualified technical problem is one of creating conditions which will enable this work to be carried out during the printing process, so that when it is time to change a stencil frame the used frame can be readily displaced to an empty site in a magazine and a stencil frame stored in another site in the magazine can be readily displaced into the printing machine.

Upon commencement of the printing process in which there is used the most recently inserted stencil frame, it may be desirable to remove from the magazine the preceding, used stencil frame while, at the same time, introducing into the magazine and making ready therein a further stencil frame for the next following sequence.

Consequently, a further technical problem is one of creating a simple arrangement which enables such exchanges to be made without undue effort and in a short space of time and in particular to provide a simple arrangement which enables used stencil frames positioned in the printing machine to be displaced therefrom into the magazine from one side, or to move into the magazine from the other side a stencil frame with associated stencil for the next following printing sequence.

A further technical problem of a particularly troublesome nature is associated with the aforesaid measures when the silk screen printing machine is to be used solely for a limited number of prints each having a different pattern but with the same colors from each of the stencils with associated stencil frames which are to be placed in sequence in the silk screen printing machine.

Consequently, a further qualified technical problem in this respect is one of creating conditions whereby during the printing of a print pattern, time can be utilized for handling a previously used stencil frame and be utilized, for preparing the stencil frame to be used in the next printing sequence, so that next stencil frame will lie in readiness in the stencil frame magazine and can therefore be displaced or moved in some other way, readily and quickly into the printing machine.

Another qualified technical problem with regard to a silk screen printing machine of the aforementioned kind and used in the aforesaid printing sequence is therefore one of providing conditions which enable a stencil-frame exchange to be effected with the aid of simple means and without manual effort, and to enable the exchange to be made in the space of a relatively short period of time while requiring but small effort on the part of the operator, and particularly so that the stencil frame intended for the next printing sequence can be inserted into a stencil frame magazine and there lie in readiness until it is needed.

Another qualified technical problem is one of creating conditions whereby a stencil frame intended for a later printing sequence and a stencil frame intended for an earlier printing sequence can be inserted into and removed from a stencil frame magazine in a ready and simple fashion.

A further qualified technical problem is one of creating conditions with the aid of simple means whereby stencil frames stored in the magazine can be displaced in one plane in solely one direction, from an arrangement delivering stencil frames to a location adjacent the magazine, into the magazine and from there to the printing machine.

Another qualified technical problem is one of creating with the aid of simple means conditions which enable stencil frames to be displaced in another plane in the magazine in solely one direction, from a silk screen printing machine to the magazine and from there to a stencil-frame receiving arrangement located externally of the magazine.

SOLUTION

The present invention now provides an arrangement intended for use in connection with a stencil frame having a stencil mounted thereon, for feeding the stencil frame to a silk screen printing machine and/or for removing the stencil frame therefrom, in which the printing machine is provided with means adapted to receive a stencil frame and means capable of holding the stencil firmly in the printing machine.

In accordance with the invention, two or more stencil frame magazines are arranged between the printing machine and a transfer arrangement for delivering a stencil frame to the magazine and/or for receiving a stencil frame therefrom.

The stencil frames are preferably arranged in the magazine one above the other, each in a respective one of a plurality of horizontal planes. Cooperating with each horizontal plane allocated in the magazine are means which are associated with the magazine and operative to feed a stencil frame to the printing machine and/or for delivering a stencil frame therefrom.

For each allocated horizontal plane in the magazine there is provided a feeding means which co-acts therewith and causes a stencil frame to leave the arrangement for positioning in the magazine and/or for removing a stencil therefrom and delivering the frame to the transfer arrangement.

The feeding means preferably comprises a reciprocatingly movable dogging means provided with catch means for moving the stencil frame in solely one direction.

In accordance with the invention, that the silk screen printing machine has a raisable and lowerable frame construction, the horizontal position of which can be adjusted so as to bring guides provided on the printing machine into register one of the horizontal planes allocated in the magazine.

The magazine is such as to accommodate in an upper plane a stencil frame which is to be displaced into the printing machine for an immediately following printing sequence, while in an adjacent lower plane there is located a site which is intended for or is occupied by a stencil frame which has been displaced from the printing machine and was used in a preceding printing sequence.

The transfer arrangement for delivering a stencil frame to the magazine and/or taking a stencil frame therefrom comprises two parallel wall sections provided with means for holding at least two stencil frames in respective horizontal planes adapted to correspond with the two horizontal planes in the magazine.

The transfer arrangement is preferably mounted with a pivot shaft in the upper part thereof.

The mutually paraliel wall sections of the arrangement have arranged thereon a first array of first wheels oriented in one plane and a second array of wheels which are oriented in an overlying plane and which can be folded away.

The invention also relates to a silk screen printing machine which is particularly adapted for use with an arrangement of the aforesaid kind and which has a raisable and lowerable frame construction which presents parallel guides intended for receiving and firmly holding a stencil frame. In this case, the squeegee and/or ink re-filling means of the printing machine shall be capable of being raised and lowered relative to the frame construction, which in turn is raisable and lowerable in relation to a printing platen or like means associated with the printing machine.

The squeegee and/or ink re-filling means are capable of being raised and lowered in an arcuate path, and in their highest position are located above a vessel for receiving ink dropping therefrom.

Those advantages primarily afforded by an arrangement according to the invention reside in the provision of conditions whereby, during a printing sequence utilizing a first stencil frame, preparations can be performed for placing a second stencil frame into a stencil frame magazine. When a stencil-frame change is to be made, the previously used first stencil frame can be readily slipped into the stencil frame magazine and immediately thereafter a second stencil frame stored in said magazine can be readily displaced into the printing machine, so that the printing sequence can be continued with the use of the second stencil frame.

BRIEF DESCRIPTION OF THE DRAWING

A preferred embodiment of the invention will now be described in more detail with reference to the accompanying drawings, in which.

DETAILED DESCRIPTION OF THE PREFERRED EMBODIMENT

Figure 1:
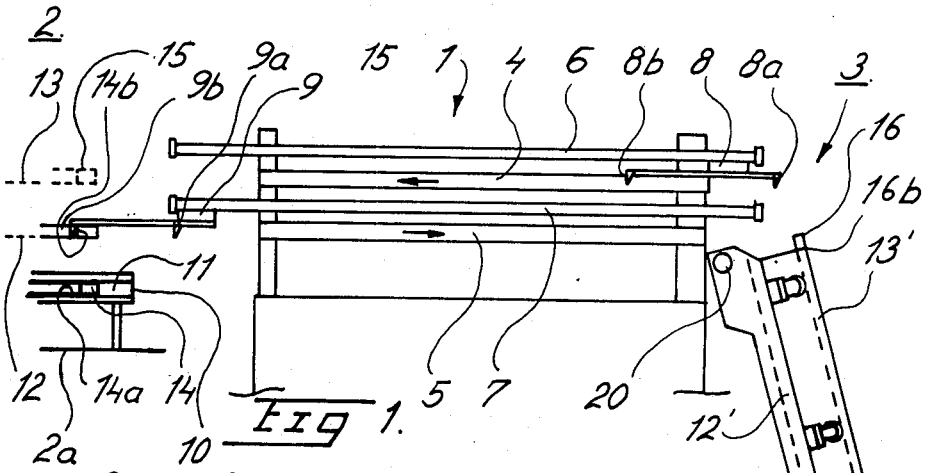
FIG. 1 is a sectional side view, of a magazine for storing two or more stencil frames, a silk screen printing machine and a transfer arrangement operative to feed a stencil frame to and/or to receive a stencil frame from the magazine.

Referring to FIG. 1 a magazine 1 is adapted to store two or more stencil frames and is located between a silk screen printing machine 2 and a transfer arrangement 3 operative to feed a stencil frame to the magazine and/or to receive a stencil frame therefrom.

The magazine 1 has parallel guides arranged in pairs in respective horizontal planes which guide horizontal movement of stencil frames having stencils mounted therein. In FIG. 1 a guide belonging to an upper guide pair is referenced 4, while a guide belonging to a lower guide pair is referenced 5. For clarity no stencil frame has been shown in the magazine 1 of FIG. 1.

It will be understood that it lies within the scope of the invention to provide an arrangement comprising more than two guide pairs, as so to form more than two horizontal stencil-frame accommodating planes, to thereby enable more than two stencil frames to be stored one above the other.

For each horizontal plane 12,13 provided in the magazine 1, for example the plane 13 through guide 4, there is provided on the magazine feeder means 6 adapted to feed a stencil frame stored in the magazine 1 to the aforesaid printing machine and/or, as the plane 12 and the guide 5 indicate, a feeder means 7 adapted to feed a stencil frame from the printing machine to the magazine 1 for storage therein.

The feeder means 6 is also adapted to collect or displace a stencil frame from the transfer arrangement 3 and move the stencil frame into the magazine 1, while the feeder means 7 is adapted to displace a stencil frame stored in the magazine 1 to the arrangement 3.

The feeder means 6 and 7 are of generally the same construction and each comprises a respective pneumatically operated reciprocatingly movable dogging means 8 and 9, the dogging means 8 being provided with members 8*a*, 8*b* and the dogging means 9 being provided with members 9*a*, 9*b*. The members 8*a*, 8*b* and 9*a*, 9*b* of respective dogging means are capable of moving the stencil frame in solely one movement direction.

The silk screen printing machine 2 has a raisable and lowerable frame construction 10, the horizontal position of which can be adjusted so that guides 11 formed in the frame construction can be caused to register with a respective horizontal plane 12,13 located in the magazine 1.

Thus, during a printing sequence in which there is used in the printing machine a first stencil frame 14 having mounted therein a stencil 14*a* exhibiting a first pattern, there can be stored in an upper plane 13 in the magazine 1, via the guides 4, a second stencil frame 15 whose stencil exhibits a different pattern. The stencil frame 15 is prepared in its stored position for displacement into the printing machine 2 for use in a subsequent printing sequence.

Upon termination of the printing sequence using the first stencil frame 14 with the stencil exhibiting the first pattern, the said stencil frame 14 is first moved into an adjacent lower plane 12 in the magazine 1, via the guide pair 5, before the second stencil frame is positioned in the printing machine 2. Thus, when the printing sequence utilizing the first stencil frame 14 is completed, the frame construction 10 must be raised to the level of the plane 12. The feed means 7 now move the dogging means 9 to the position shown in FIG. 1, so that the member 9*b* can be caused to co-act with the inner edge 14*b*, of the stencil frame 14. When the dogging means 9 is then moved to the far right in FIG. 1, the stencil frame 14 will be displaced along the guides 11 and 5, and take a position in the magazine 1.

The first stencil frame 14 has now left the printing machine 2 and the machine is ready to receive a second stencil frame 15.

The frame construction 10 of the printing machine 2 is then raised to the level of the horizontal plane 13 and the dogging means 8, located in the position illustrated in FIG. 1, is moved to the left. The member 8*b* lies against the outer edge part of the stencil frame 15 and moves the frame 15, with the stencil exhibiting said second pattern thereon, along the guides 4 and the guides 11 into the frame construction 10 of the printing machine, the second stencil frame 15 being optionally locked securely to the guides 11 in a known manner. The frame construction 10 is then lowered to the printing position adjacent the printing platen 2*a* and new printing sequence can commence.

In this position there is stored in a plane 12 in the magazine 1 a first stencil frame 14 which has been used and which is to be cleaned, while a plane 13 is free to receive a third stencil frame intended for a subsequent printing sequence.

The transfer arrangement 3 now takes the position illustrated in FIG. 1 and the third stencil frame 16 is arranged in an inclined plane 13' and supporting by wheels located therein. An inclined plane 12' extending parallel with the plane 13' and having wheels positioned therein is left free.

The transfer arrangement 3 is now swung about a pivot axis 20 to a horizontal position (indicated by broken lines in FIG. 2) so that the third stencil frame 16 is oriented in the plane 13 and the plane 12' in the plane 12. By again moving the dogging means 9 to a position far to the left of the magazine 1, the member 9*a* engages the outer edge of the first stencil frame and upon renewed movement of the dogging means 9 to the right the used stencil frame will be moved into the transfer arrangement 3 and take a position in the plane 12.

A third stencil frame 16 with stencil mounted therein intended for the next printing sequence is now positioned in the transfer arrangement 3, in the plane 13, and the dogging means 8, via its member 8*a*, is caused to co-act with the inner edge part 16*b* of the stencil frame, so as to move the stencil frame to the left in FIG. 1, whereupon the stencil frame 16 is moved along guides 4 to a position in the magazine 1. This is effected by displacing the dogging means 8 to its terminal position to the left in FIG. 1. When the stencil frame 16 is in position in the magazine 1, the dogging means 8 is permitted to return to the position shown in FIG. 1, in which the member 8*b* of the dogging means abuts the outer edge portion of the stencil frame 16 in readiness to displace the stencil frame 16 into the printing machine 2 as soon as the frame construction 10 is in register with the horizontal plane 13.

Figure 2:
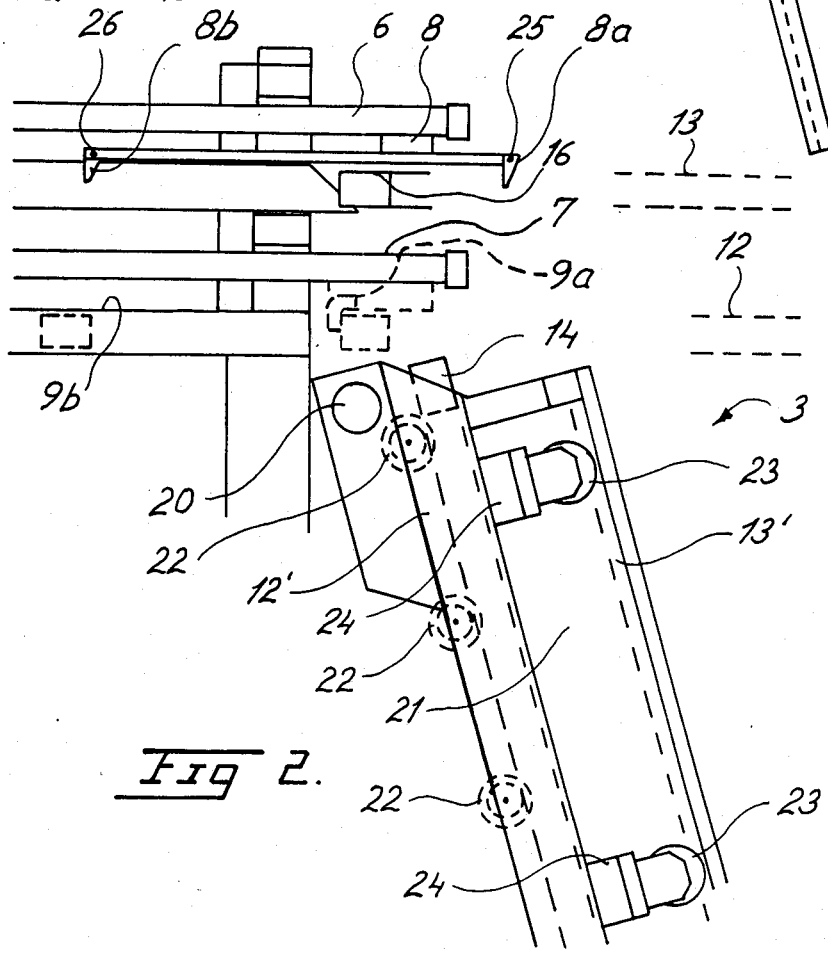
FIG. 2 is a side view in larger scale than FIG. 1, showing the co-action of the arrangement for feeding a stencil frame to the magazine and/or receiving a stencil frame therefrom with the magazine storing two or more stencil frames.

FIG. 2 illustrates in somewhat larger scale the coaction between the transfer arrangement 3 and the magazine 1. In FIG. 2 the arrangement 3 has reverted to the state illustrated in FIG. 1, i.e. the third stencil frame has left the transfer arrangement 3 and is stored in the magazine 1, while the first stencil frame 14 has been received by the transfer arrangement 3 in the plane 12'.

As will be seen from FIG. 2, the dogging means 8 has a catch means 8*a* which can be pivoted about a peg 25 and a catch means 8*b* which can be pivoted about a peg 26, these pivoting movements only being able to take place in a clockwise direction, the illustrated position constituting a stop position. Thus, when the dogging means 8 is moved to the right the catch member 8*a* yields to the edge 16*a* of the stencil frame but again falls down to the FIG. 2 position so that when the dogging means 8 is moved to the left the catch member 8*a* will hook onto the stencil frame 16 so that it can leave the transfer arrangement 3.

The member 8*b* is constructed in principally the same manner, and is thus able to displace the frame 16 solely in a direction towards the left in FIG. 1.

The catch means 9*a* and 9*b* are generally of the same construction, although with the difference that in their case rotation can only be effected in a counter-clockwise direction, in view of the fact that displacement is to be effected in the opposite direction.

As will be seen from FIG. 2, the arrangement 3 for feeding a stencil frame to the magazine 1 and/or receiving a stencil frame therefrom comprises two mutually parallel, identical and mirror-image wall sections, of which only one is shown in FIG. 2, namely that referenced 21.

This wall section is provided with means for enabling at least two stencil frames to be held in a respective horizontal plane 12', 13' and adapted for rotation to horizontal planes 12 and 13 of the magazine 1. To this end, the parallel wall sections of the arrangement have a first array of first wheels 22, oriented in a plane 12', and a second array of second wheels oriented in an overlying plane 13', the latter wheels being referenced 23 and capable of being swung away with the aid of a shaft 24, to facilitate removal of the first frame 14.

Figure 3:
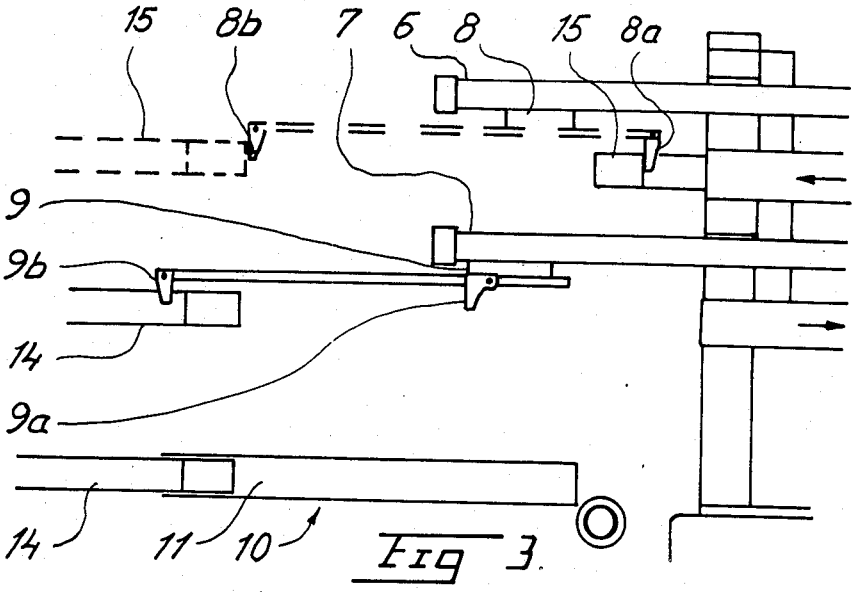
FIG. 3 illustrates the magazine in which two or more stencil frames are stored in combination with a silk screen printing machine.
Figure 4:
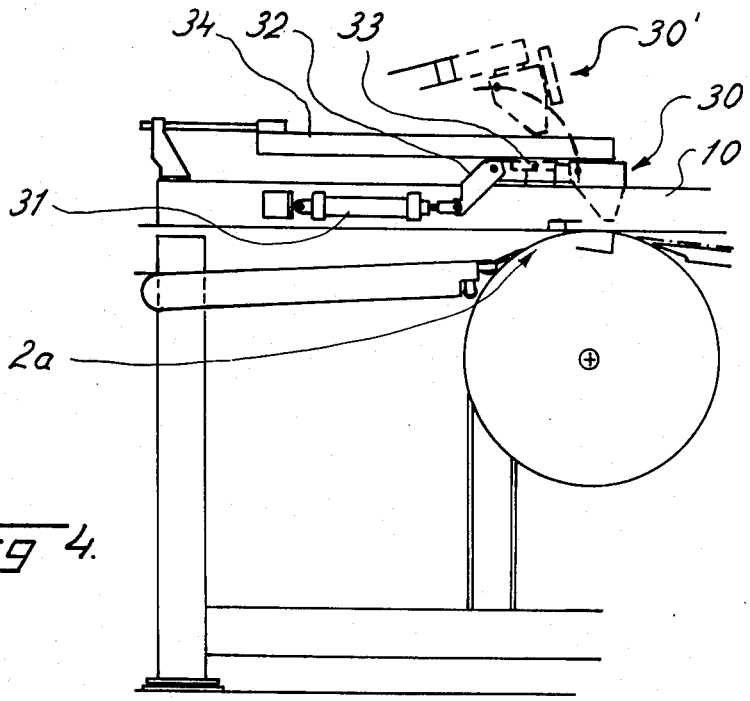
FIG. 4 is a side view of part of a silk screen printing machine suitable for use in connection with an arrangement according to FIG. 1.

The present invention also relates to a silk screen printing machine adapted for use with an arrangement or a magazine 1 according to the above, in which the silk screen printing machine illustrated in FIGS. 3 and 4 has been provided with a raisable and lowerable frame structure 10 having mutually parallel guides 11 intended for receiving and holding a stencil frame 14. The squeegee and/or ink refilling means 30 of such a silk screen printing machine is capable of being raised and lowered in relation to the frame construction 10, which in turn can also be raised and lowered in relation to a printing platen, printing drum *2a* or the like forming part of the printing machine.

The squeegee and/or ink refilling means 30 is raised by a piston-cylinder device 31 which acts upon a link system 32 in a manner to move said squeegee and/or ink refilling means in an arcuate path from the position 30 to the position 30'.

When occupying the position 30', the squeegee and/or ink refilling means is, or are, located immediately above a vessel 33 adapted to receive ink dropping from the squeegee and/or ink refilling means. The squeegee and/or ink refilling means 30 is, or are, connected to a frame structure 34 co-acting with the link system 32.

It also lies within the scope of the invention for the magazine 1 to be raisable and lowerable so that each of the planes allocated therein can be brought into register with the guides 11 of the printing machine.

Although in the aforegoing there has been described means for feeding a stencil frame from the magazine to the silk screen printing machine and removing and receiving a stencil frame therefrom, it will be understood that it lies within the scope of the invention to utilize the arrangement solely as a means for feeding a given stencil frame from a number of stencil frames to the silk screen printing machine.

It will be understood that the invention is not restricted to the aforedescribed embodiments, given by way of example, and that modifications can be made within the scope of the invention as defined in the following claims. 15

What is claimed is:

1. A printing apparatus utilizing stencil frames, said apparatus comprising:

a magazine comprising first and second guide means for guiding stencil frames through first and second opposing sides of said magazine along first and second horizontal paths, respectively, first feeder means for moving stencil frames along said first horizontal path in a first direction toward said first side from said second side, second feeder means for moving stencil frames along said second horizontal path in an opposite direction from said first direction;

a transfer arrangement adjacent said first opposing side comprising means for receiving stencil frames from said first feeder means and means for transferring stencil frames from said recieving means to a position adjacent an upstream end of said second path; and a printing arrangement positioned adjacent said second opposing side including printer guide means for transferring stencil frames from a downstream end of said second path to a printing machine and from said printing machine to an upstream end of said first path;

said first and second guide means being disposed vertically of one another, said first feeder means including a first pair of catches disposed along said first path in horizontally spaced relationship to each other and means for reciprocating said first pair of catches along said first path, said first pair of catches adapted to drivingly engage stencil frames while moving in said first direction and to pass stencil frames without driving engagement while moving in said opposite direction, said second feeder means including a second pair of catches disposed along said second path in horizontally spaced relationship to each other and means for reciprocating said second pair of catches along said second path, said second pair of catches adapted to drivingly engage stencil frames while moving in said opposite direction and to pass stencil frames without driving engagement while moving in said first direction, rearward catches of said first and second pairs of catches adapted to engage stencil frames at said upstream ends of said first and second paths, respectively, and to move said stencil frames from said upstream ends into said first and second guide means of the magazine, respectively, forward catches of said first and second pairs of catches adapted to push stencil frames out from said first and second guide means to said downstream ends of said first and second paths, respectively, the forward and rear catches of the same catch pair being in fixed spaced relationship with each other so as to reciprocate simultaneously.

2. A silk screen printing machine adapted in particular for use with the apparatus according to claim 1 and having a raisable and lowerable frame construction with parallel guides adapted to receive and to hold a stencil frame, a printer element including at least one of a squeegee and ink refilling means, a platen and means for moving said printer element between raised and lowered positions in relation to the frame construction, which frame construction can be raised and lowered in relation to said printing platen.

3. The silk screen printing machine according to claim 2, wherein said printer elements is raised and lowered along arcuate path so as to be located at said raised position above a vessel for receiving ink dripping from said printer element.

4. A silk screen printing machine adapted in particular for use with the apparatus according to claim 1 and having a raisable and lower frame construction with pparallel guides adapted to receive and to hold a stencil frame, a printer element including at least one of a squeegee and ink refilling means, a platen and means for moving said printer element between raised and lowered positions in relation to the frame construction, which frame construction can be raised and lowered in relation to said printing platen.

5. The printing apparatus of claim 1, wherein said receiving means of the transfer arrangement includes a first set of rollers adapted to support a stencil frame at said downstream end of said first path, said transferring means of the transfer arrangement including a second set of rollers for supporting a stencil frame at said upstream end of said second path, means for retracting and protracting said second rollers, said transfer arrangement including a frame supporting said first and second sets of rollers and means for pivoting said frame from a first position adjacent said first opposing side whereat said first and second sets of rollers are aligned with said first and second paths, respectively, and a second position retracted from said first opposing side.

6. A silk screen printing machine adapted in particular for use with the arrangement according to claim 5 and having a raisable and lower frame construction with parallel guides adapted to receive and to hold a stencil frame, a printer element including at least one of a squeegee and ink refilling means, a platen and means for moving said printer element between raised and lowered positions in relation to the frame construction, which frame construction can be raised and lowered in relation to said printing platen.

7. The printing apparatus of claim 5, wherein said frame of the transfer arrangement includes side walls.

8. The printing apparatus of claim 5, wherein said first path is beneath said second path.

9. A silk screen printing machine adapted in particular for use with the arrangement according to claim 8 and having a raisable and lower frame construction with parallel guides adapted to receive and to hold a stencil frame, a printer element including at least one of a squeegee and ink refilling means, a platen and means for moving said printer element between raised and lowered positions in relation to the frame construction, which frame construction can be raised and lowered in relation to said printing platen.

10. The silk screen printing machine according to claim 9, wherein said printer element is raised and lowered along an arcuate path so as to be located at said raised position above a vessel for receiving ink dropped from said printer element.

* * * * *